US011903488B1

(12) United States Patent
Larsen et al.

(10) Patent No.: US 11,903,488 B1
(45) Date of Patent: Feb. 20, 2024

(54) MECHANISM FOR ARTICULATING CONVERTIBLE FURNITURE

(71) Applicant: American Leather Operations, LLC, Dallas, TX (US)

(72) Inventors: Anders Larsen, Coppell, TX (US); Stephen Stockton, Coppell, TX (US); Douglas L. Gasal, Dallas, TX (US); Kevin Nguyen, Carrollton, TX (US)

(73) Assignee: American Leather Operations, LLC, Dallas, TX (US)

( * ) Notice: Subject to any disclaimer, the term of this patent is extended or adjusted under 35 U.S.C. 154(b) by 0 days.

(21) Appl. No.: 17/985,521

(22) Filed: Nov. 11, 2022

Related U.S. Application Data

(60) Provisional application No. 63/411,848, filed on Sep. 30, 2022.

(51) Int. Cl.
*A47C 17/23* (2006.01)

(52) U.S. Cl.
CPC ..... *A47C 17/23* (2013.01)

(58) Field of Classification Search
CPC ..... A47C 17/04; A47C 17/16; A47C 17/165; A47C 17/175; A47C 17/207; A47C 17/2076; A47C 17/22; A47C 17/23; A47C 17/225
USPC ..... 5/27
See application file for complete search history.

(56) References Cited

U.S. PATENT DOCUMENTS 334,528 A * 1/1886 Hemmenway ..... G06Q 10/0631 5/28
382,743 A * 5/1888 Waldo ..... A47C 17/16 5/52
1,248,702 A * 12/1917 Percival ..... A47C 17/225 5/310

(Continued)

FOREIGN PATENT DOCUMENTS

CA 2774915 C 8/2017
CN 108185712 A 6/2018

(Continued)

OTHER PUBLICATIONS

Stalmot Smart Ideas, Haiti KO 012-5 Sleeper Sofa, https://www.stalmot.com/products/en/32/sleeping/1/9/haiti, available at least as early as Sep. 29, 2022, accessed using the Wayback Machine Internet Archives Dec. 30, 2022, 1 page.

(Continued)

*Primary Examiner* — David R Hare
(74) *Attorney, Agent, or Firm* — Womble Bond Dickinson (US) LLP

(57) ABSTRACT

Convertible furniture includes a first arm, a first seat, and a base. The first seat is adjacent the first arm and includes a head panel, a mid-panel, and a foot panel. The first seat has a seat configuration in which the head panel is in a vertical orientation. The first seat has a bed configuration in which the head panel, the mid-panel, and the foot panel are each in a horizontal orientation with a top surface of each cooperating to form a flat surface. The base has a side rail that is secured to the first arm and a center support parallel to and spaced apart from the first arm. The head panel of the first seat at least partially supported by the side rail and the center support in the deployed position thereof when the first seat is in the bed configuration.

20 Claims, 11 Drawing Sheets

(56) References Cited

U.S. PATENT DOCUMENTS

| | | | | | |
|---|---|---|---|---|---|
| 1,295,935 | A * | 3/1919 | Sowle | A47C 17/2076 | 5/59.1 |
| 1,945,186 | A | 1/1934 | Frank | | |
| 1,951,805 | A * | 3/1934 | Palmieri | A47C 17/22 | 5/503.1 |
| 3,048,855 | A * | 8/1962 | Frank | A47C 17/165 | 297/124 |
| 3,093,410 | A | 6/1963 | Forest | | |
| 3,456,267 | A * | 7/1969 | Black | A47C 17/04 | 5/8 |
| 3,504,940 | A * | 4/1970 | Friese | A47C 17/22 | 297/109 |
| 3,596,984 | A * | 8/1971 | Jones | A47C 17/22 | 297/75 |
| 3,864,764 | A * | 2/1975 | Janusc | A47C 17/134 | 5/36 |
| 4,343,054 | A | 8/1982 | Kane | | |
| 5,423,596 | A * | 6/1995 | Laughlin | A47C 17/225 | 297/440.1 |
| 5,568,658 | A | 10/1996 | Madden | | |
| 5,740,564 | A * | 4/1998 | Hankins | A47C 17/225 | 5/13 |
| 7,827,629 | B1 | 11/2010 | Guillot | | |
| 8,672,405 | B2 | 3/2014 | Solheim | | |
| 8,893,323 | B2 * | 11/2014 | Garland | A47C 17/17 | 5/42 |
| 8,997,273 | B2 | 4/2015 | Murphy et al. | | |
| 9,072,386 | B2 | 7/2015 | Solheim | | |
| 9,144,319 | B2 | 9/2015 | Murphy et al. | | |
| 9,173,502 | B2 * | 11/2015 | Smith | A47C 17/165 | |
| 9,357,850 | B2 | 6/2016 | Murphy et al. | | |
| 9,642,468 | B2 | 5/2017 | Murphy et al. | | |
| 9,668,585 | B2 | 6/2017 | Garland | | |
| 9,814,321 | B2 | 11/2017 | Garland | | |
| 9,895,002 | B1 | 2/2018 | Cooke et al. | | |
| 10,499,745 | B2 * | 12/2019 | Adams | A47C 17/04 | |
| 10,506,883 | B2 | 12/2019 | Hirschhaut | | |
| 10,993,541 | B2 | 5/2021 | Garland | | |
| 11,083,303 | B2 | 8/2021 | Hirschhaut | | |
| 2011/0167558 | A1 * | 7/2011 | Harris | A47C 17/2073 | 5/18.1 |
| 2014/0352056 | A1 * | 12/2014 | Thurow | A47C 17/16 | 5/17 |
| 2020/0221878 | A1 | 7/2020 | Chen et al. | | |
| 2021/0212473 | A1 | 7/2021 | Garland | | |
| 2022/0160136 | A1 | 5/2022 | Jablonski et al. | | |

FOREIGN PATENT DOCUMENTS

| | | | | | |
|---|---|---|---|---|---|
| DE | 8806592 | U1 | 8/1988 | | |
| DE | 8902661 | U1 | 4/1989 | | |
| DE | 102004045024 | B3 * | 4/2006 | A47C 17/134 | |
| GB | 2300120 | A | 10/1996 | | |
| IT | 201800002323 | U1 | 5/2020 | | |
| WO | 2019222019 | A1 | 11/2019 | | |
| WO | WO-2021211383 | A1 * | 10/2021 | A47C 17/22 | |

OTHER PUBLICATIONS

Luonto, Nico King Size Loveseat Sleeper, https://www.luonto.com/shop/nico-king-size-sofa-sleeper-13861?category=125#attr=949309,949311, available at least as early as Sep. 29, 2022, 7 pages.

* cited by examiner

MECHANISM FOR ARTICULATING CONVERTIBLE FURNITURE

CROSS-REFERENCE TO RELATED APPLICATION

This application claims the benefit of, and priority to, U.S. Provisional Patent Application Ser. No. 63/411,848, filed Sep. 30, 2022, the entire contents of which are hereby incorporated by reference.

BACKGROUND

1. Technical Field

The present disclosure relates to convertible furniture and, more specifically, to mechanisms for articulating convertible furniture from a seat configuration to a bed configuration.

2. Discussion of Related Art

Convertible furniture can include a sofa bed that can be converted between a bed configuration and a sofa or seat configuration. One type of convertible furniture can include three bed sections with mattress portions integrally formed on each of the sections. The mattress portion can be of some thickness to be comfortable when laid upon as a bed section. Collectively, the three sections form the bed when the sofa bed is deployed. An articulating mechanism can connect two or more of the sections to guide their movement between the bed configuration and the seat configuration. To this end, convertible furniture can be bulky compared to contemporary traditional seats due to having to stow the multiple bed sections and the articulating mechanism. Additionally, traditional seats can be designed with more aesthetic consideration than existing convertible furniture as traditional seats are not constrained in also having to function as an articulating bed.

In addition to being constrained in certain aesthetic appeal, convertible furniture of the types described above can be difficult to transition between the seat configuration and the bed configuration and vice versa. The bed sections can be heavy, particularly to a large subset of the population, to lift out of the seat frame or to stow back into the seat frame. The high threshold to articulate the convertible furniture is often by design to provide stability to the convertible furniture when in the seat configuration or in the bed configuration. To this end, the convertible furniture is less likely to fold while being laid upon or to unfold without clear actions by a user.

In addition, convertible furniture can be complicated to manufacture. The components, including the bed sections and the articulating mechanism, can be bulky. The articulating mechanism can include a series of metallic linkage components of varying shapes, sizes, and angles, while the seat sections are made of fabric. Great care is often expended to avoid damaging the fabric portion of the seat sections, in particular, during the assembling of the seat sections to the articulating mechanism.

SUMMARY

This disclosure relates generally to mechanisms for convertible furniture. The mechanisms disclosed herein may include a gap closing mechanism that closes a gap between two adjacent seats when the seats are in a bed configuration. The mechanisms disclosed herein may include a head panel support assembly that supports the sides of the head panel in the deployed configuration. The mechanisms disclosed herein may include a deployment assist/soft-close assembly that urges one or more panels of a seat towards a deployed position thereof.

In an embodiment of the present disclosure, a gap closing mechanism for convertible furniture includes a dome and a mid-panel. The dome is configured to secure to an arm of the convertible furniture. The mid-panel of the convertible furniture has a contact portion that is configured to engage the some such that the mid-panel is urged away from the dome to reduce or eliminate a gap between the mid-panel and an adjacent mid-panel. The dome may have a height in a range of 0.25 inches to 1.5 inches towards the mid-panel.

In another embodiment of the present disclosure, convertible furniture includes a first arm, a second arm, a first seat, and a first dome. The first seat is adjacent the first arm includes a head panel, a mid-panel, and a foot panel. The first seat has a seat configuration in which the head panel is in a vertical orientation and the mid-panel and the foot panel are each in a horizontal orientation with the mid-panel inverted below the foot panel. The first seat has a bed configuration in which the head panel, the mid-panel, and the foot panel are each in a horizontal orientation with a top surface of each cooperating to from a flat surface. The second seat is positioned between the first seat and the second arm. The second seat has a seat configuration in which the head panel is in a vertical orientation and the mid-panel and the foot panel are each in a horizontal orientation with the mid-panel inverted below the foot panel. The second seat has a bed configuration in which the head panel, the mid-panel, and the foot panel are each in a horizontal orientation with a top surface of each cooperating to from a flat surface. The first dome is secured to the first arm. The mid-panel of the first seat is engaged with the first dome in the bed configuration of the first seat to urge the mid-panel of the first seat towards the mid-panel of the second seat to close a gap therebetween.

In embodiments, the convertible furniture includes a second dome secured to the second arm. The mid-panel of the second seat engaged with the second dome in the bed configuration of the section seat to urge the mid-panel of the second seat towards the mid-panel of the first seat to close the gap therebetween.

In some embodiments, the convertible furniture includes a pivot bar that extends between the first arm and the second arm. The mid-panel of the first seat rotatably secured to the pivot bar such that the mid-panel rotates about the pivot bar between a stored position which the first seat is in the seat configuration and a deployed position when the first seat is in the bed configuration.

In certain embodiments, the convertible furniture includes a biasing mechanism that is configured to urge the mid-panel of the first seat form the stored position thereof to the deployed configuration thereof. The biasing mechanism may provide less force than required to rotate the mid-panel of the first seat from the stored position to the deployed configuration. The biasing mechanism may cease to urge the mid-panel of the first seat form the stored position towards the deployed position after the mid-panel of the first seat has rotated 90 degrees about the pivot bar.

In particular embodiments, the biasing mechanism includes a torsion spring that has a body disposed about the pivot bar, a first leg engaged with the first dome, and a second leg that is engaged with the mid-panel.

In embodiments, the convertible furniture includes a frame that has a side rail that is secured to the first arm and a center support that is disposed between the first arm and the second arm. The head panel of the first seat is supported by the side rail and the center support in a deployed position thereof when the first seat is in the bed configuration. The head panel of the first seat may include an arm tab that extends from the head panel towards the first arm, the arm tab resting on the side rail when the head panel of the first seat is in the deployed position. The head panel of the first seat may include a center tab that extends from the head panel towards the second arm. The center tab may rest on the center support when the head panel of the first seat is in the deployed position. The head panel of the second seat may include a center tab that extends from the head panel towards the first arm, the center tab resting on the center support when the head panel of the second seat is in the deployed position. The center tab of the second seat longitudinally offset from the center tab of the first seat.

In another embodiment of the present disclosure, convertible furniture includes a first arm, a first seat, and a base. The first seat is adjacent the first arm and includes a head panel, a mid-panel, and a foot panel. The first seat has a seat configuration in which the head panel is in a vertical orientation. The mid-panel and the foot panel are each in a horizontal orientation with the mid-panel inverted below the foot panel. The first seat has a bed configuration in which the head panel, the mid-pane, and the foot panel are each in a horizontal orientation with a top surface of each cooperating to form a flat surface. The base has a side rail that is secured to the first arm and a center support parallel to and spaced apart from the first arm. The head panel of the first seat at least partially supported by the side rail and the center support in the deployed position thereof when the first seat is in the bed configuration.

In embodiments, the head panel of the first seat includes an arm tab that extends from the head panel towards the first arm. The arm tab may rest on the side rail when the head panel is in the deployed position. Only the arm tab of the head panel may rest on the side rail when the head panel of the first seat when the head panel is in the deployed position.

In some embodiments, the head panel of the first seat includes a center tab that extends from the head panel away from the first arm. The center tab may rest on the center support when the head panel of the first seat is in the deployed position. Only the center tab of the head panel rests on the center support when the head panel is in the deployed position.

In certain embodiments, the convertible furniture includes a second arm and a second seat. The second seat positioned between the first seat and the second arm and includes a head panel, a mid-panel, and a foot panel. The second seat has a seat configuration in which the head panel is in a vertical orientation and the mid-panel and the foot panel are each in a horizontal orientation with the mid-panel inverted below the foot panel. The second seat has a bed configuration in which the head panel, the mid-panel, and the foot panel are each in a horizontal orientation with a top surface of each cooperating to form a flat surface. The head panel of the second seat include a center tab that extends form the head panel of the second seat towards the first arm. The center tab of the head panel of the second seat resting on the center support when the head panel of the second seat is in the deployed position. The center tab of the second seat offset from the center tab of the head panel of the first seat along the center support. On the deployed position, only the center tab of the head panel of the second seat may rest on the center support in the deployed position In particular embodiment, the convertible furniture includes a gap closing mechanism that has a first dome secured to the first arm. The mid-panel of the first seat engaged with the first dome in the bed configuration of the first seat to urge the mid-panel of the first seat away from the first arm. The gap closing mechanism may include a contact surface on the bottom of the mid-panel.

In some embodiments, the convertible furniture includes a pivot bar that extends between the first arm and the center support. The mid-panel of the first seat may be rotatably secured to the pivot bar such that the mid panel rotates about the pivot bar between a stored position when the first seat is in the seat configuration and a deployed position when the first seat is in the bed configuration. The convertible furniture may include a first biasing mechanism that is configured to urge the mid-panel of the first seat from the stored position thereof to the deployed position thereof. The first biasing mechanism may provide less fore than required to rotate the mid-panel of the first seat from the stored position to the deployed position. The first biasing mechanism may cease to urge the mid-panel of the first seat from the stored position towards the deployed position after the mid-panel of the first seat has rotated 90 degrees about the pivot bar. The first biasing mechanism may include a torsion spring that has a body disposed about the pivot bar. A first leg of the torsion spring may be engaged with the first dome and a second leg of the torsion spring may be engaged with the mid-panel.

In another embodiment of the present disclosure, convertible furniture includes a base and a head panel. The base has a side rail, a back rail, and a center support. The side rail and the center support parallel to one another and perpendicular to the back rail. The head panel has a stored position in which the head panel is substantially vertical in orientation and a deployed position in which the head panel is horizontal in orientation. The head panel supported by the side rail and the center support in the deployed position thereof.

In embodiments, the head panel is substantially rectangular in shape and includes a first tab and a second tab that extend laterally from sides of the head panel. The first tab resting on the side rail and the second tab resting on the center support in the deployed position. Only the first tab of the head panel may rest on the side rail when the head panel is in the deployed position and only the second tab rests on the center support when the head panel is in the deployed position.

In some embodiments, the convertible furniture includes a backrest adjacent the back rail. The backrest may define a cavity that receives the head panel in the stored position thereof.

In another embodiment of the present disclosure, convertible furniture includes a first arm, a second arm, a first seat, a second seat, and a base. The first seat is adjacent the first arm and includes a first head panel, a first mid-panel, and a first foot panel. The first seat has a seat configuration in which the first head panel is in a vertical orientation. Fir first seat has a bed configuration in which the first head panel, the first-mid-panel, and the first foot panel are each in a horizontal orientation with a top surface of each cooperate to forma flat surface. The first head panel of the of the first seat have a first center tab that extends form a side of the first head panel towards the second arm. The second seat is between the first seat and the second arm and includes a second head panel, a second mid-panel, and a second foot panel. The second seat has a seat configuration in which the head panel in a vertical orientation. The second seat has a bed configuration in which the second head panel, the second mid-panel, and the second foot panel are each in a horizontal orientation with a top surface of each cooperating to from a flat surface. The second head panel of the second seat having a second center tab that extends form a side of the second heat panel towards the first arm. The base has a center support that is disposed between the first arm and the second arm. The first center tab rests on the center support in the horizontal orientation of the first head panel. The second center tab rests on the center support in the horizontal orientation of the second head panel. The first center tab offset from the second center tab along the center support.

In embodiments, the first head panel includes a first arm tab that extends form the first head panel towards the first arm and the second head panel includes a second arm tab that extends form the second head panel towards the second arm. The base includes a first side rail attached to the first arm and a second side rail attached to the second arm. The first arm tab resting on the first side rail to support the first head panel in a horizontal orientation thereof. The second arm tab of the second head panel rests on the side rail to support the second head panel in the horizontal orientation thereof.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
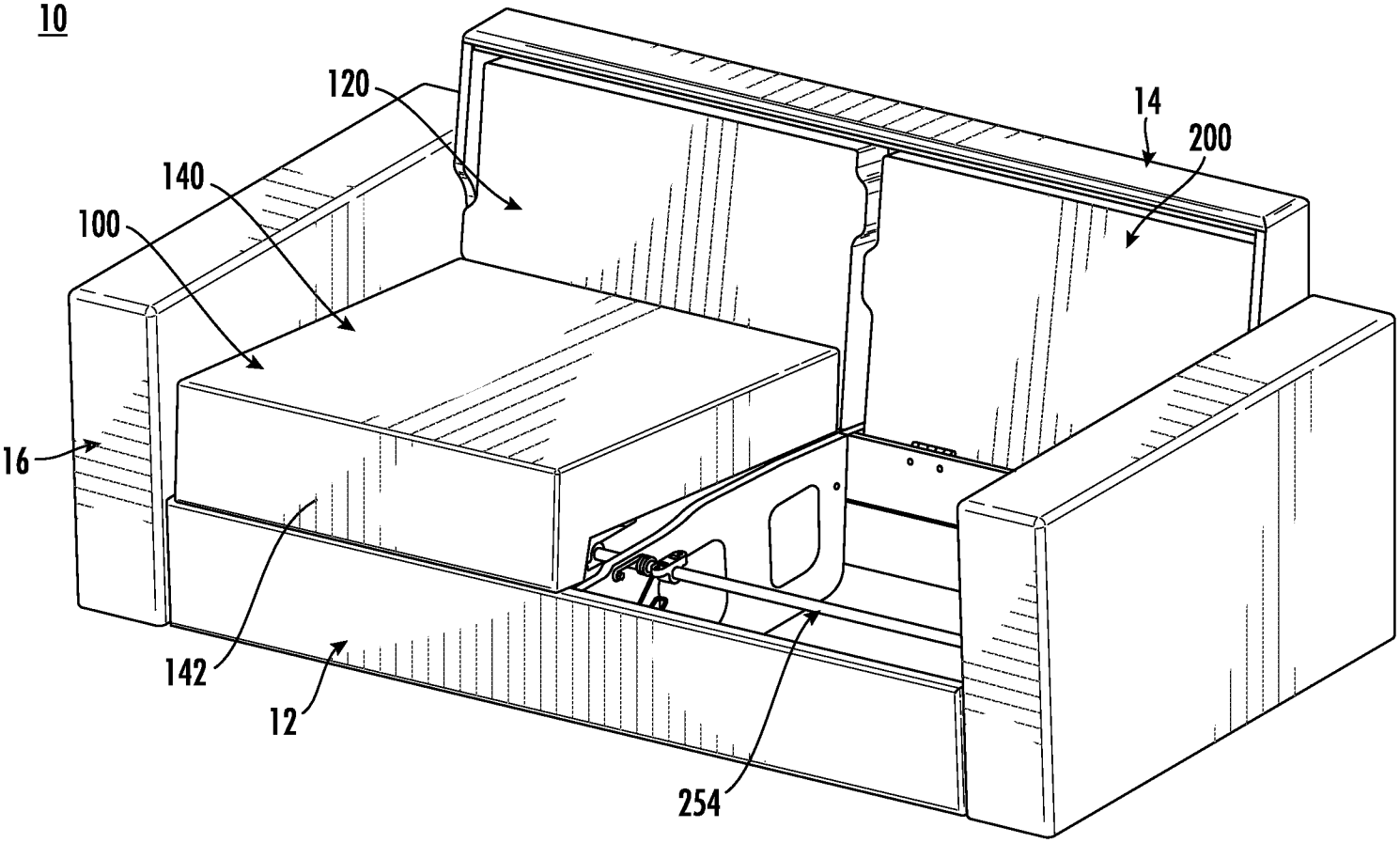
FIG. 1 is a perspective view of a piece of convertible furniture provided in accordance with the present disclosure with a first seat of the convertible furniture in a second seat configuration and another seat of the convertible furniture partially removed.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used herein, the term "convertible furniture" refers to a seat having a first or seat configuration and a second or bed configuration. Convertible furniture as used herein may refer to a single seat or multi-seat unit. For example, convertible furniture may have a single seat, two seats, three seats, or more than three seats. Each seat of the convertible furniture may be independently articulatable between the seat configuration and the bed configuration. In some embodiments, one or more of the seats of the convertible furniture may articulate in concert with one another between the seat configuration and the bed configuration.

Figure 2:
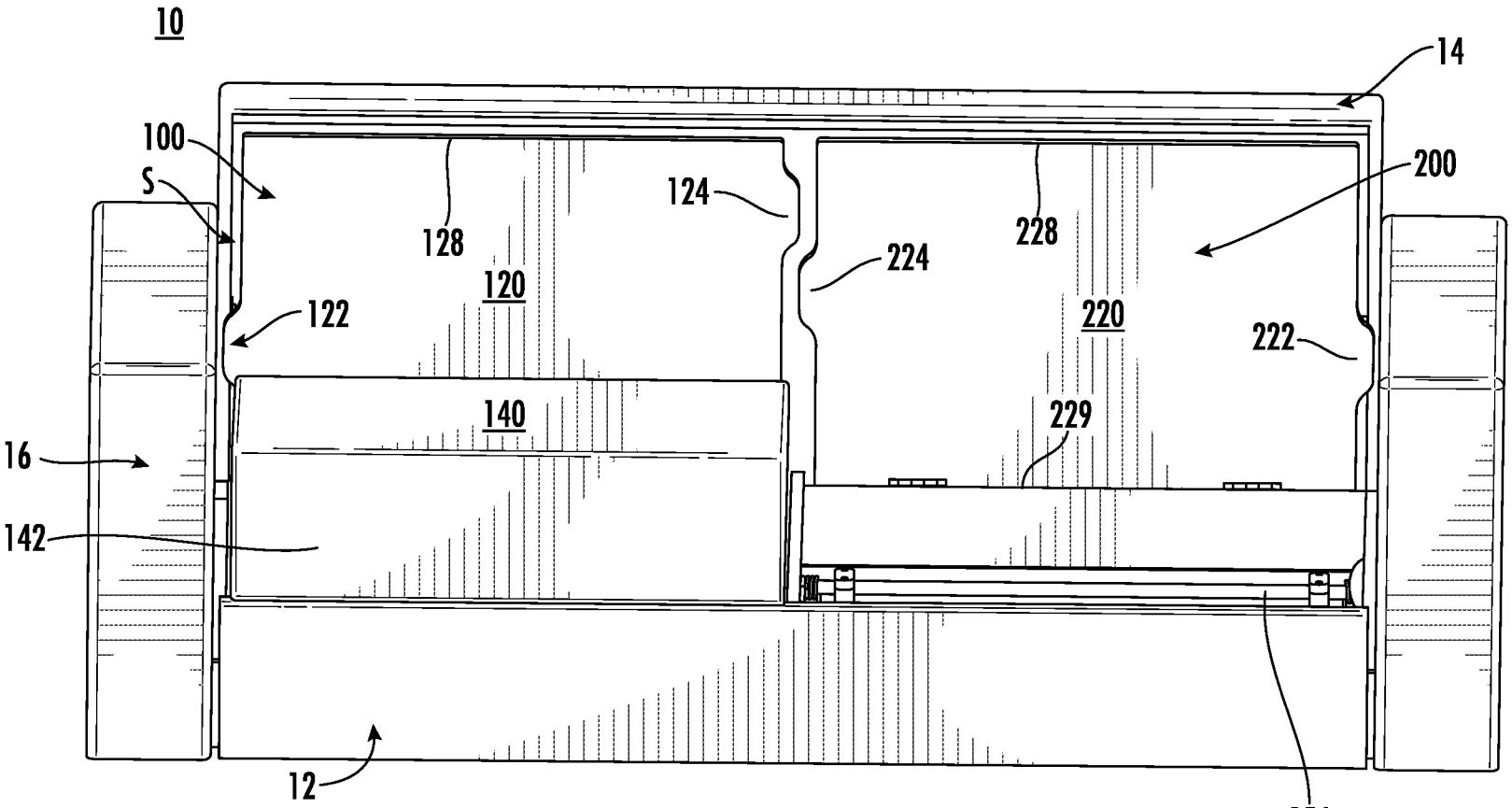
FIG. 2 is a front, perspective view of the convertible furniture of FIG. 1.

Referring now to FIGS. 1 and 2, a piece of convertible furniture 10 is provided in accordance with the present disclosure in a seat configuration thereof. The convertible furniture 10 includes a base 12, a backrest 14, and arms 16 that remain fixed and may provide support for or house components of the convertible furniture 10 that articulate relative to the base 12. The convertible furniture 10 may include removable cushions (not shown) that rest on the backrest 14 and conceal articulatable components in the seat configuration of the convertible furniture 10. The convertible furniture 10 may also include one or more pillows or cushions that rest adjacent the arms 16. The removable cushions may increase comfort of the convertible furniture 10 in the seat configuration thereof. As shown the convertible furniture 10 includes a first seat 100 and a second seat 200 that are independently articulatable between the seat configuration and a bed configuration thereof.

Figure 3:
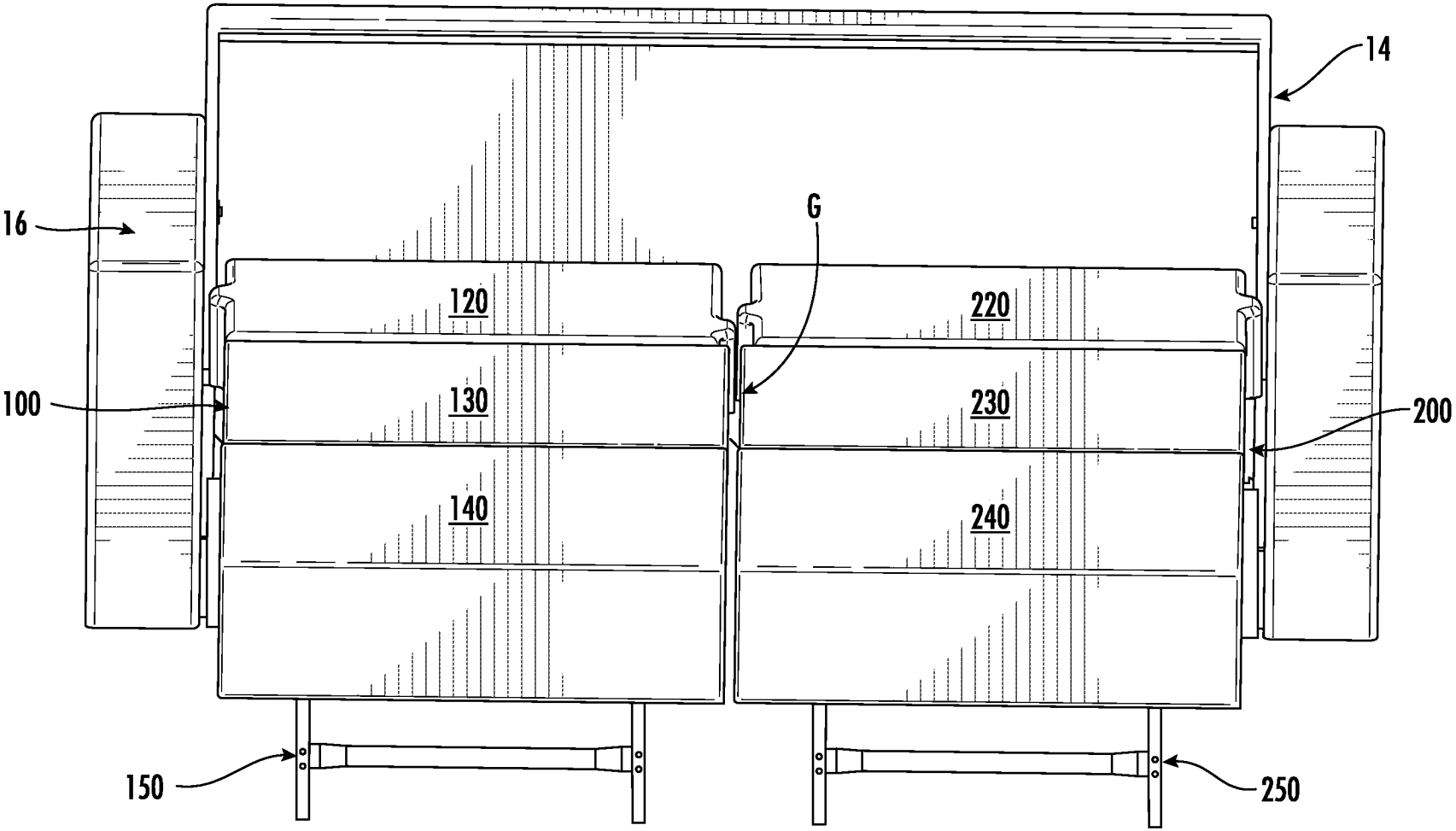
FIG. 3 is a front perspective view of the convertible furniture of FIG. 1 with the first seat and the second seat thereof each in a bed configuration thereof.

With additional reference to FIG. 3 which illustrates the convertible furniture 10 with the first seat 100 in the bed configuration thereof. The components of the first seat 100 and the second seat 200 are detailed below with respect to first seat 100 with similar components represented with similar labels with the leading "1" of the components of the first seat 100 replaced with a leading "2" for the component of the second seat 200. The first seat 100 includes articulatable components including a first or a head panel 120, a second or mid-panel 130 (FIG. 11), and a third or foot panel 140. Each of the head panel 120, the mid-panel 130, and the foot panel 140 include a cushion secured thereto that is configured to act as a mattress in a bed configuration of the first seat 100. In the seat configuration, the cushion 142 of the foot panel 140 forms a seat of the first seat 100 which is substantially horizontal in orientation. In the bed configuration, the foot panel 140 is in a deployed position that is furthest from the backrest 14 and is in a substantially horizontal orientation. The foot panel 140 may be supported in the bed configuration by a foldable frame 150 which described in greater detail below.

The mid-panel 130 is in a deployed position between the head panel 120 and the foot panel 140 in the bed configuration as shown in FIG. 3. In the bed configuration, the mid-panel 130 is substantially horizontal in orientation and may be supported in the bed configuration by the foldable frame 150 and/or the base 12. The mid-panel 130 is hinged to the foot panel 140 such that the foot panel 140 rotates relative to the foot panel 140 such that in the stored position of the mid-panel 130, the mid-panel 130 is inverted and positioned below the foot panel 140 in a substantially horizontal orientation as shown in FIGS. 1 and 2.

Figure 4:
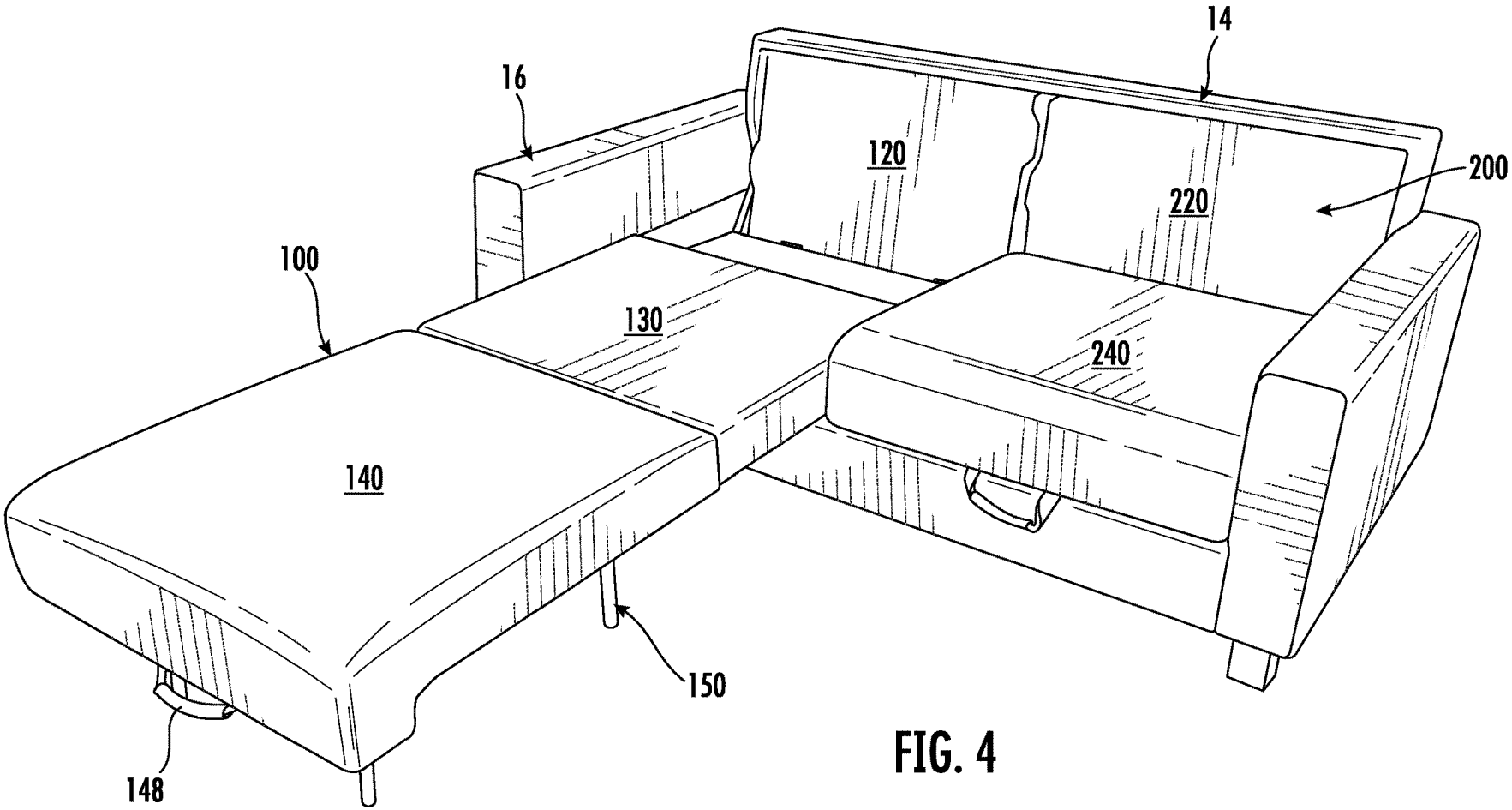
FIG. 4 is a perspective view of a piece of convertible furniture provided in accordance with the present disclosure with a first seat thereof in an intermediate configuration and a second seat thereof in a seat configuration.

Referring now to FIGS. 1-4, in the seat configuration, the head panel 120 is in a stored position and received or nested within the backrest 14 in a substantially vertical orientation. With particular reference to FIG. 4, in an intermediate configuration, between the seat configuration and the bed configuration, the foot panel 140 and the mid-panel 130 are in a deployed position and the head panel 120 remains in its stored position nested within the backrest 14. As shown, the head panel 120 is hinged to the base 12 such that the head panel 120 folds down to a substantially horizontal orientation in its deployed position such that the first seat 100 is in the bed configuration as shown in FIG. 3. In the bed configuration, the head panel 120 is supported by the base 12 and the mid-panel 130 as described in greater detail below.

With particular reference to FIG. 3, the convertible furniture 10 includes a first seat 100 and a second seat 200 that are independently articulatable between the bed configuration (first seat 100) and the seat configuration (seat 200). When both the first seat 100 and the second seat 200 are in the bed configuration, a gap "G" may be defined between the mid-panel 130 and the foot panel 140 of the first seat 100 and the mid-panel 230 and the foot panel 240 of the second seat 200. It may be beneficial to minimize or eliminate this gap "G". Minimizing or eliminating this gap "G" may increase comfort in a bed configuration and/or increase safety by preventing items or appendages from being captured between the mid-panels 130, 230 and the foot panels 140, 240.

Figure 5:
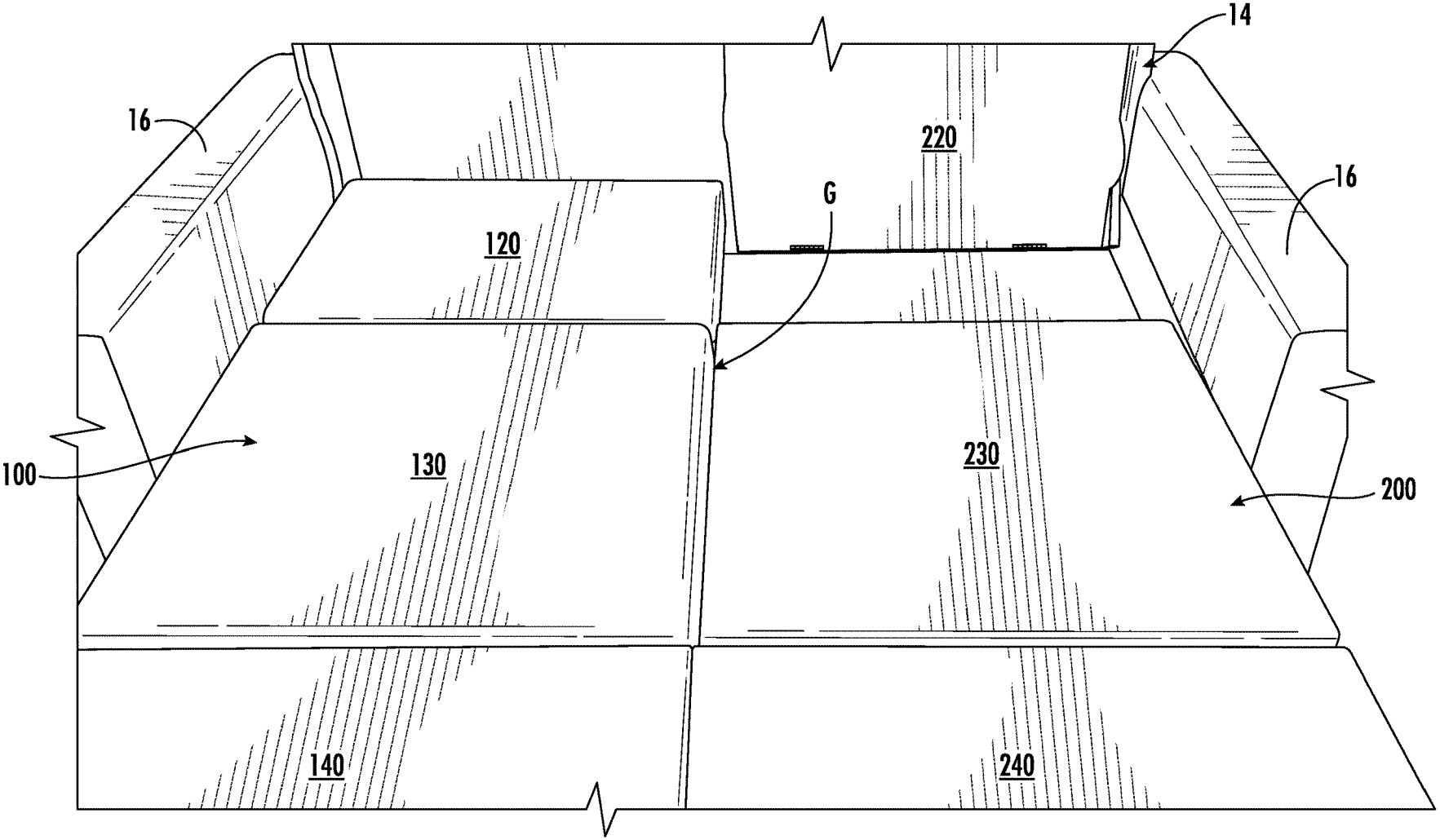
FIG. 5 is a front, perspective view of the convertible furniture of FIG. 4 with the first seat in the bed configuration and the second seat in an intermediate configuration.
Figure 7:
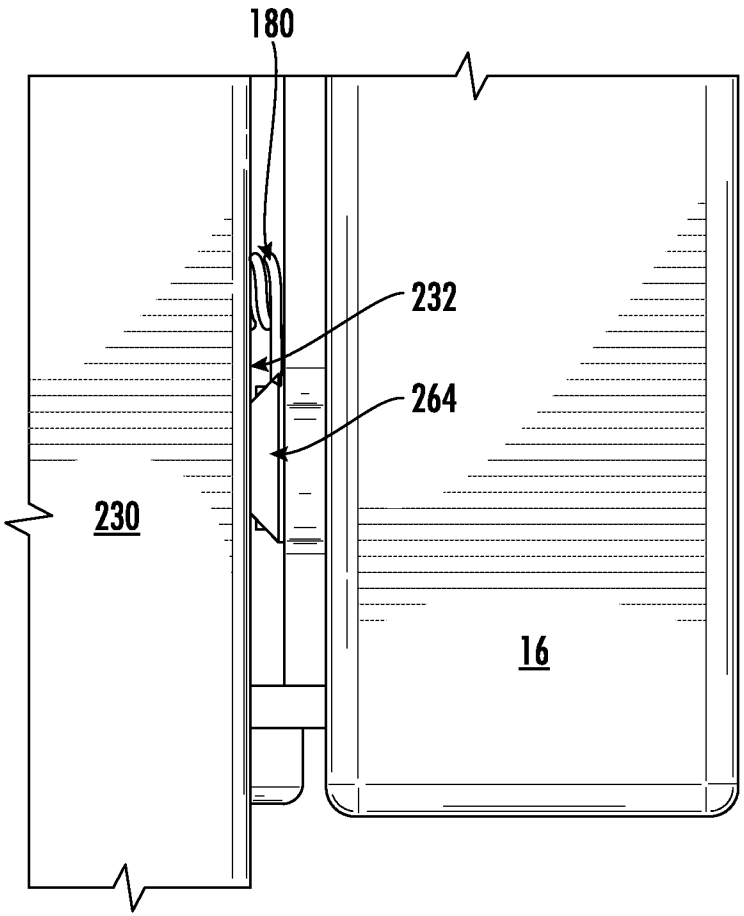
FIG. 7 is a top view of the gap closing mechanism of FIG. 6 with the second seat in the bed configuration.
Figure 6:
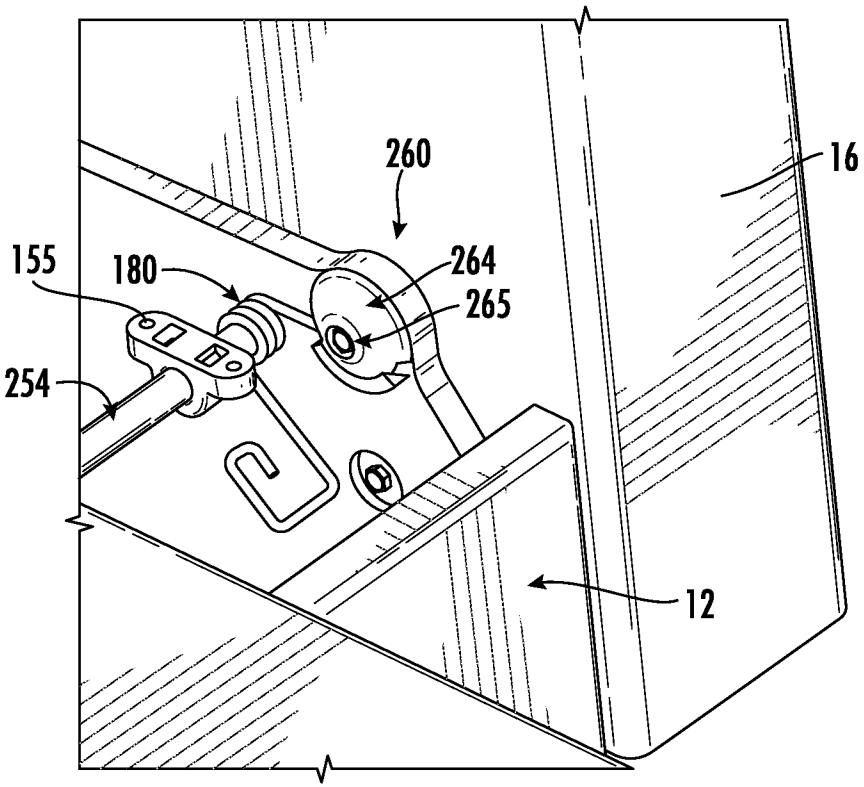
FIG. 6 is an enlarged view of a gap closing mechanism of the convertible furniture of FIG. 1 with the second seat removed.

Referring now to FIGS. 5-7, a gap closing mechanism 160, 260 is described in accordance with the present disclosure. Each seat 100, 200 of the convertible furniture 10 may include a gap closing mechanism 160, 260 with like elements represented with similar labels. As such, only the gap closing mechanism 260 of the second seat 200 will be detailed herein for reasons of brevity. The gap closing mechanisms 160, 260 are configured to reduce or eliminate the gap G between the mid-panels 130, 230 and the foot panels 140, 240 by urging the respective mid-panels 130, 230 and foot panels 140, 240 towards one another.

With particular reference to FIG. 6, the gap closing mechanism 260 includes a dome 264 that is secured to the arm 16 adjacent a pivot bar 254 of the frame 250 of the second seat 200. The pivot bar 254 is secured to the arm 16 and a mid-support 252 that is positioned between and parallel to the arms 16. The pivot bar 254 may extend the width of the convertible furniture 10 such that the pivot bar 254 of the second seat 200 is the same bar as the pivot bar 154 of the first seat. The mid-panel 230 is rotatably and slidably secured to the pivot bar 254. Specifically, the mid-panel 230 is rotatable about the pivot bar 254 and is slidable in a transverse direction towards or away from a respective arm 16. The mid-panel 230 may be fixed in a longitudinal direction, e.g., in a direction that extends between a front and a back of the base 12. The pivot bar 254 may be secured slightly below and behind a center of the dome 264 such that the mid-panel is positioned below the dome 264 as shown in FIG. 6.

As the mid-panel 230 is rotated or deployed from the seat configuration to the bed configuration, the mid-panel 230 rotates about the pivot bar 254 such that a contact portion 232 of the mid-panel 230 contacts the dome 264 to urge the mid-panel 230 away from the arm 16 and towards the mid-panel 130 of the first seat 100 as shown in FIG. 6. As the mid-panel 230 is urged away from the arm 16, the gap "G" is closed or eliminated. The contact portion 232 of the mid-panel 230 may include a contact insert 233 to reduce wear on the mid-panel 230 (shown as contact insert 133 in FIG. 11) and may increase a width of the mid-panel 230 towards the arm 16. The increased width may further reduce the gap "G". In some embodiments, the mid-panel 230 is provided without a contact insert 233. In some embodiments, urging the mid-panel 230 may be preventing the mid-panel from moving towards the arm 16 by the dome 264 without moving the mid-panel 230 away from the arm 16.

The dome 264 may be secured to the arm 16 by a fastener 265 that extends through the dome 264 to fix the dome 264 to the arm 16. The fastener 265 may fix the dome 264 to the arm 16 or may allow the dome 264 to rotate about the fastener 264 as the mid-panel 230 contacts the dome 264. The dome 264 may extend from the arm 16 in a range of 0.125 inches to 1.5 inches, e.g., 0.375, 0.5, 0.75, 1, or 1.25 inches. In some embodiments where one of the seats 100, 200 is not adjacent an arm, e.g., arm 16, the dome 264 may be secured to a center support of the base 12 to urge the respective seat 100, 200 towards the other seat 100, 200.

With reference to FIGS. 2 and 8-10 the convertible furniture 10 includes a head panel support structure 170, 270 provided in accordance with the present disclosure. Each seat 100, 200 of the convertible furniture 10 includes similar features with similar elements represented with similar labels. With particular reference to FIG. 2, and noted above, in the seat configuration and the intermediate configuration the head panel 120 is in a substantially vertical orientation and nested within the backrest 14 of the convertible furniture 10. The head panel 120 has an arm tab 122, a center tab 124, a center recess 126, and a front edge 128. The head panel 120 also includes a rear edge 129 that is hinged to a rear support 19 of the base 14. The rear edge 129 may be hinged by one or more hinges that support and fix the head panel 120 to rotate from being nested within the backrest 14 (FIG. 3) to a substantially horizontal orientation as shown in FIG. 4. In the horizontal orientation, the top of the cushion of the head panel 120 is substantially co-planar with the top of the cushion of the mid-panel 130 and the foot panel 140.

In the horizontal orientation, the head panel 120 is supported by the hinge on the rear edge 129, by the arm tab 122, by the center tab 124, and by the front edge 128. Supporting the head panel 120 by the arm tab 122 and the center tab 124 may prevent the weight on the front edge 128 of the head panel 120 from rotating the mid-panel 130 towards the stored position. Specifically, without the arm tab 122 and the center tab 124 supporting the head panel 120 as detailed below, it may be possible for the head panel 120 to urge the mid-panel 130 towards the stored position which may be disconcerting to a person sitting on the convertible furniture in the bed configuration.

Figure 8:
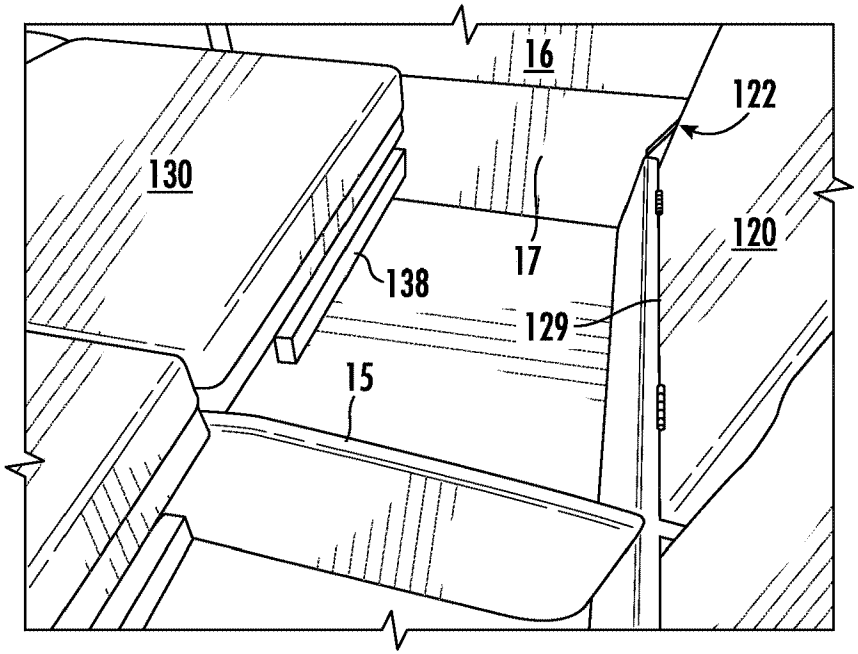
FIG. 8 is a side, perspective view of the convertible furniture of FIG. 4 with the first seat and the second seat thereof in an intermediate configuration with a mid-panel and a foot panel in a deployed position and a head panel in a stored position.

The arm tab 122 of the head panel 120 extends from the head panel 120 towards the arm 16 as shown in FIG. 3. The arm tab 122 is positioned below a top of the arm 16. In the horizontal orientation, the arm tab 122 is supported on a side rail 17 of the base 12 that is secured to the arm 16 (FIGS. 7 and 8). Having the arm tab 122 extend towards the arm 16 allows for a space "S" between the head panel 120 and the arm 16. The space "S" allows for clearance between the head panel 120 and the arm 16 as the head panel 120 is rotated towards the horizontal orientation. In some embodiments, the arm 16 may include cavity to accommodate rotation of the arm tab 122 as the head panel 120 is rotated towards or away from the horizontal orientation. In embodiments, in the horizontal position, only the arm tab 122 of the head panel 120 rest on the side rail 17 to support the head panel 120. In some embodiments, no other portion of the head panel 120 contacts or rests on the side rail 17 other than the arm tab 12 in the horizontal position.

The inside edge of the head panel 120 which is opposite the arm 16 includes the center tab 124 and may include a center recess (not shown). The center tab 124 is offset from the center recess. The center tab 124 extends from the head panel 120 and supports the head panel 120 on a center support 15 of the base 12 when the head panel 120 is in the deployed position. The center recess is sized and dimensioned to accommodate a center tab 226 of the adjacent head panel 220. In embodiments, in the horizontal position, only the center tab 124 of the head panel 120 rest on the center support 15 to support the head panel 120. In some embodiments, no other portion of the head panel 120 contacts or rests on the center support 15 other than the center tab 124 in the horizontal position.

Figure 9:
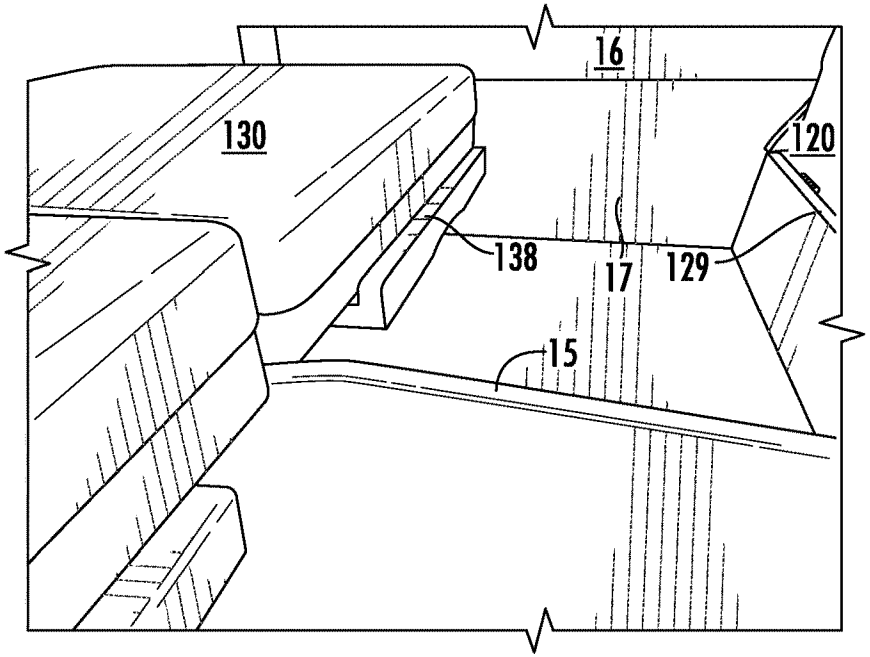
FIG. 9 is another side, perspective view of the convertible furniture of FIG. 8.
Figure 10:
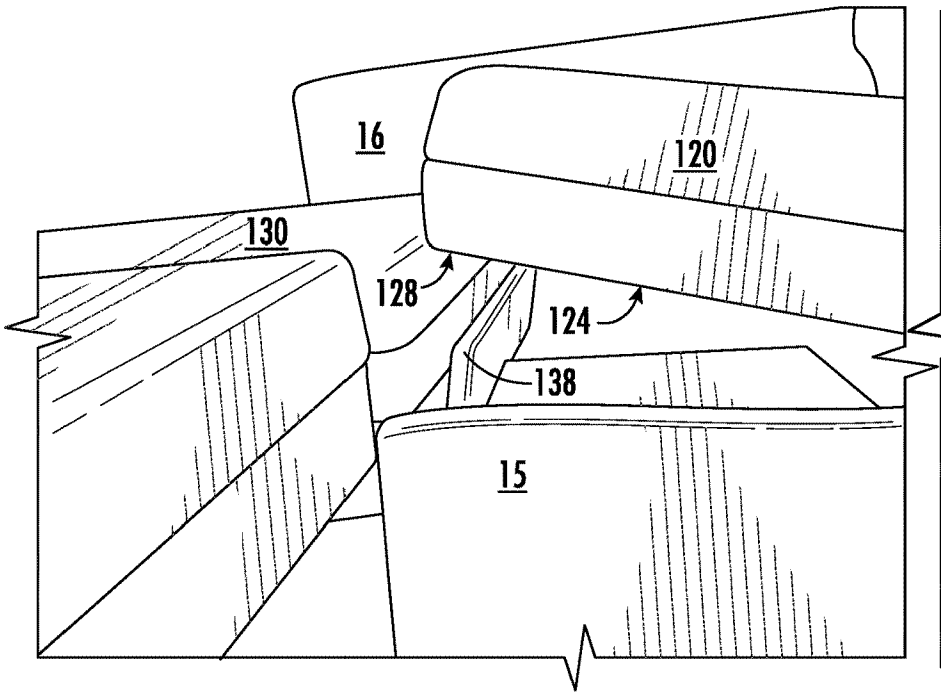
FIG. 10 is a side, perspective view of the convertible furniture of FIG. 8 with the head panel of the first seat moved partially towards the deployed position thereof.

The front edge 128 of the head panel 120 is supported by a head panel support 138 that is secured to mid-panel 130. The head panel support 138 extends rearward from the mid-panel 130 when the mid-panel 130 is in the deployed position as shown in FIGS. 8-10. Referring briefly back to FIG. 2, the head panel 120 is substantially rectangular in shape with the arm tab 122 and the center tab 124 extending laterally from sides of the head panel 120.

Figure 11:
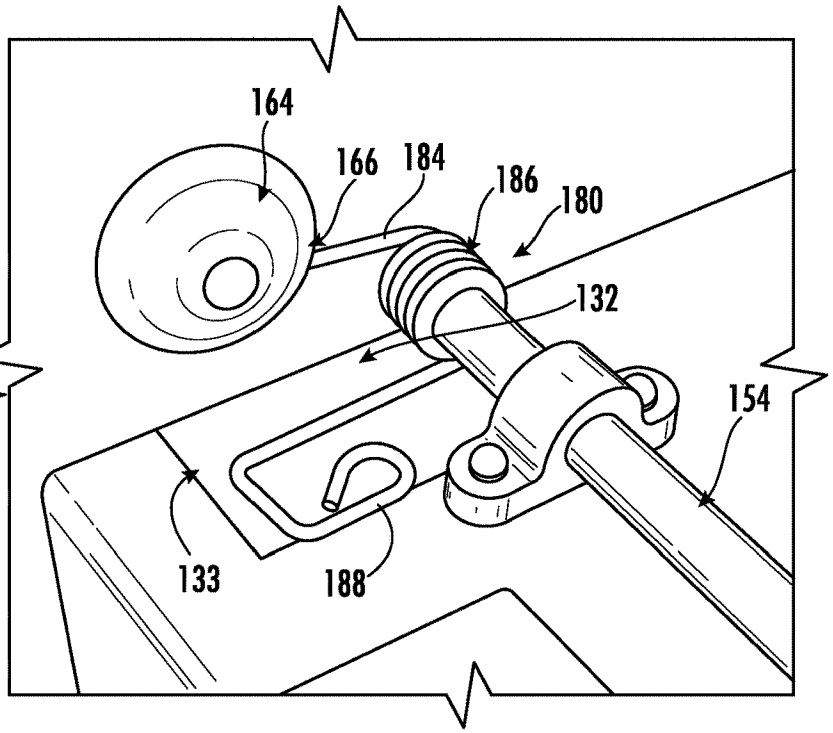
FIG. 11 is an enlarged top, perspective view of a biasing mechanism of the first seat of the convertible furniture of FIG. 4 with the mid-panel in a stored position thereof.

Referring now to FIG. 11, the convertible furniture 10 may include a biasing mechanism 180 that assists in deploying the seat 100, 200 from the seat configuration to the bed configuration and/or assists in a soft close during storing of the seat 100, 200 from the bed configuration to the seat configuration. As shown, the biasing mechanism 180 includes a torsion spring 182 that is disposed about the pivot bar 154 of the folding frame 150. The torsion spring 182 includes a first leg 184, a body 186, and a second leg 188. The body 186 includes one or more coils 187 that wrap around the pivot bar 154. The first leg 184 extends from the body 186 and is engaged with the dome 164. In some embodiments, the first leg 184 is received within a channel 166 defined by the dome 164. The second leg 188 is engaged with a bottom surface of the mid-panel 130. In certain embodiments, the mid-panel 130 may include an insert or reinforcement 133 to reinforce the surface of the mid-panel 130 and to prevent damage to the mid-panel 130. The insert 133 may also function as the contact insert 133 for contacting the dome 164 in the deployed position thereof as described with respect to the gap adjustment mechanism 170.

As shown, the biasing mechanism 180 may assist in deployment of the mid-panel 130 from the stored position to the deployed position. The biasing mechanism 180 may urge the mid-panel 130 from its stored position towards its deployed position. The biasing mechanism 180 may provide a force that aids in the rotation of the mid-panel 130 about the pivot bar 154 such that the mid-panel 130 is urged towards the deployed position. In embodiments, the biasing mechanism 180 may provide a force for only part of the deployment of the mid-panel 130. For example, the biasing mechanism 180 may provide a force to urge the mid-panel 130 towards the deployed position until the mid-panel 130 is at or beyond an over center position for the respective seat 100, 200 by being rotated in a range of 300 to 1350 about the pivot bar 154 from the stored position, e.g., until the mid-panel is rotated 45°-90°. Once the mid-panel 130 is rotated beyond the over center position of the respective seat 100, 200, gravity may assist in further rotation of the mid-panel 130 its deployed position.

In certain embodiments, the biasing mechanism 180 may slow rotation of the mid-panel 130 towards the stored position thereof to assist with a slow close. For example, once the mid-panel 130 reaches an over center position, the biasing mechanism 180 may slow the rotation of the mid-panel 130 towards the stored position by urging the mid-panel 130 towards the deployed position thereof. While the biasing mechanism 180 urges the mid-panel 130 towards the deployed position, the force provided by the biasing mechanism 180 may be insufficient to overcome the effects of gravity but enough to slow rotation of the mid-panel 130 such that rotation of the mid-panel 130 towards the stored position is slowed but not prevented. The biasing mechanism 180 may slow the rotation of the mid-panel 130 once the mid-panel reaches a range of 45° to 135° of rotation from the stored position.

Urging the mid-panel 130 towards the deployed position thereof may aid in the deployment of the mid-panel 130 and the foot panel 140 from the stored position to the deployed position thereof. Aiding the deployment of the mid-panel 130 and the foot panel 140 may reduce a force required to deploy the mid-panel 130 and the foot panel 140. Reducing the force required to deploy the mid-panel 130 may allow for single hand deployment of the foot panel 140 and the mid-panel 130. Slowing rotation of the mid-panel 130 towards the stored position may increase control of the mid-panel 130 and the foot panel 140 as the mid-panel 130 and the foot panel 140 are moved towards the stored position thereof.

Figure 12:
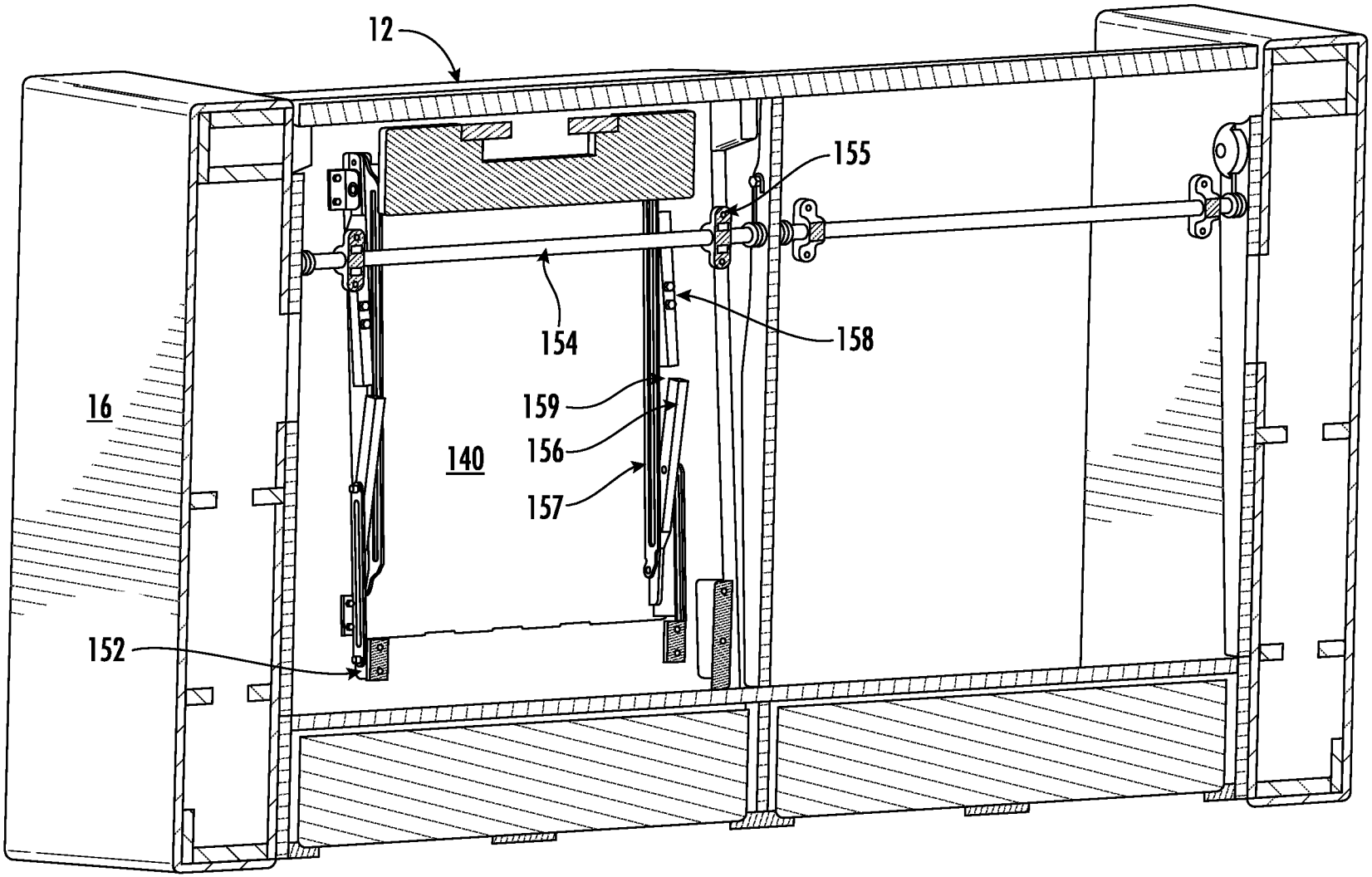
FIG. 12 is a bottom view of the convertible furniture of FIG. 1 with the mid-panel removed.
Figure 13:
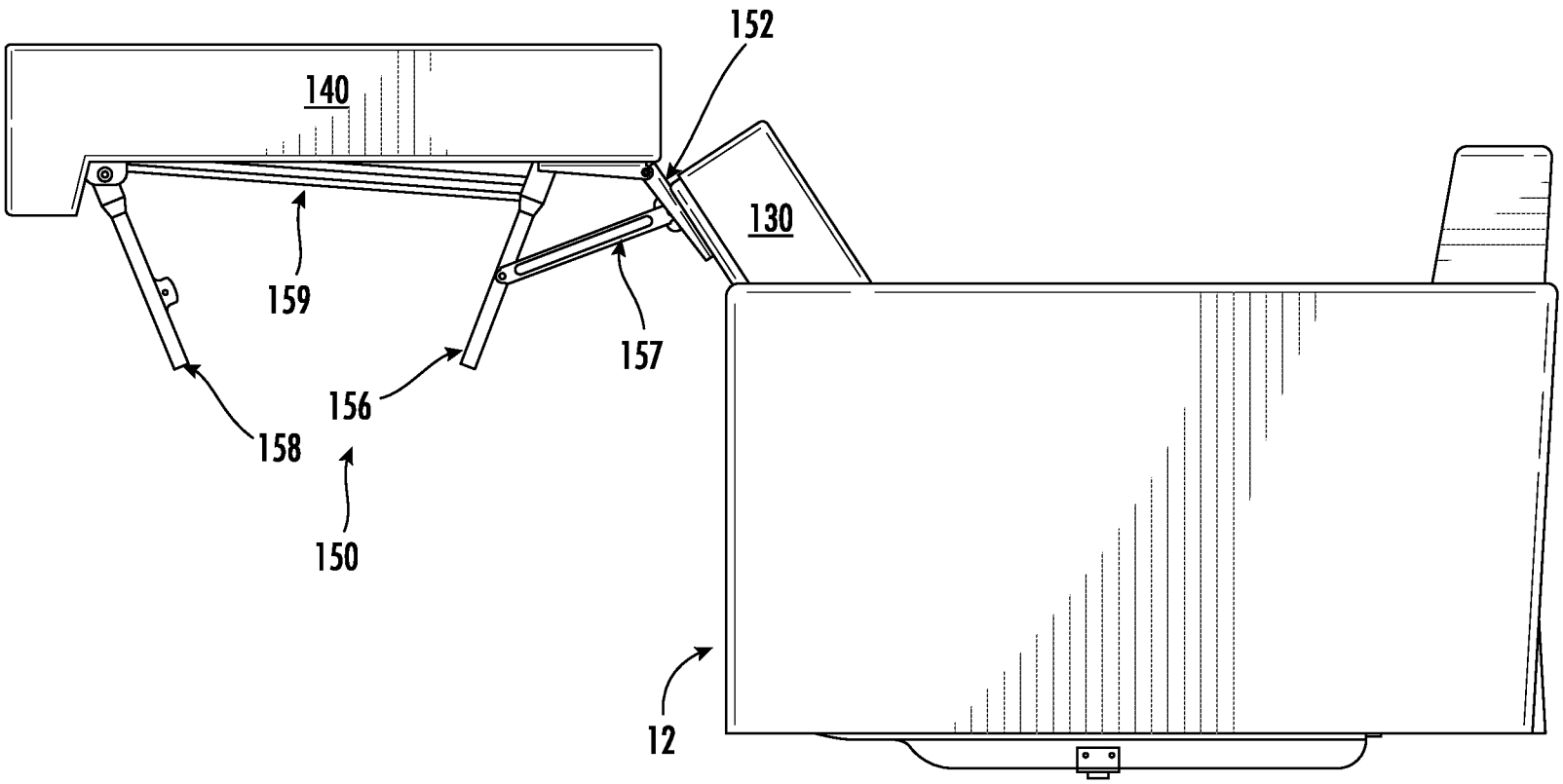
FIG. 13 is a side view of the convertible furniture of FIG. 1 with the first seat in an intermediate configuration.
Figure 14:
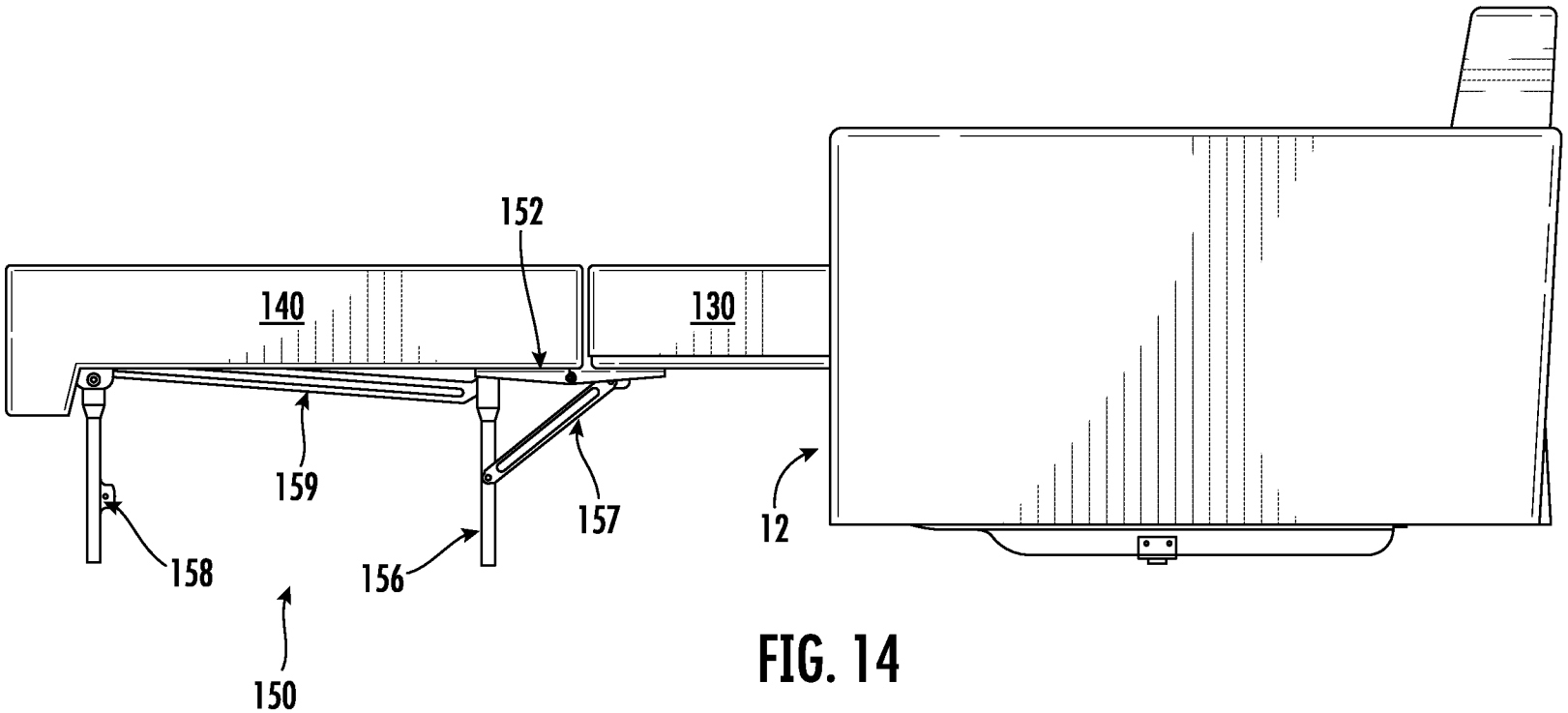
FIG. 14 is a side view of the convertible furniture of FIG. 1 with the first seat in the bed configuration.

With reference now to FIGS. 12-14, the folding frame 150 is described with respect to the first seat 100. The folding frame 150 is folded between the mid-panel 130 and the foot panel 140 in the seat configuration and supports the foot panel 140 and the mid-panel in the bed configuration. The folding frame 150 includes a hinge 152, the pivot bar 154, a rear leg 156, and a front leg 158. The hinge 152 is secured to the mid-panel 130 and the foot panel 140 to hingedly secure the mid-panel 130 and the foot panel 140. The folding frame 150 further includes a rear link 157 that is pivotally connected at a first end to a rear wing of the hinge 152 that is secured to the mid-panel 130 and that is pivotally connected at a second end to the rear leg 156. The rear leg 156 is pivotally connected at a top end to a front wing of the hinge 152 that is secured to the foot panel 140. The folding frame 150 also includes a front link 159 that is secured on a first end to the rear leg 156 and that is pivotally secured to the top of the front leg 158. The top of the front leg 158 being pivotally connected to the bottom of the foot panel 140. The mid-panel 130 is rotatably secured to the pivot bar 154 by one or more brackets 155 that allow the mid-panel 130 to rotate about the pivot bar 154 and may allow the mid-panel 130 to translate in a direction along a longitudinal axis of the pivot bar 154. The front link 159 and/or the rear link 157 may be disposed between the front leg 158 and the rear leg 156. The geometry of the folding frame 150 may allow for a single-handed deployment or storage of the mid-panel 130 and the foot panel 140. One or both of the front legs 158 and the rear legs 156 may include a crossbar that extends between the pair of front legs 158 and the pair of rear legs 156.

With particular reference to FIG. 12, in the seat configuration of the seat 100, the front leg 158 and the rear leg 156 are longitudinally folded between the mid-panel 130 and the foot panel 140. A bottom of the front leg 158 may oppose a bottom of the rear leg 156 such that the front leg 158 and the rear leg 156 are aligned in a folded position thereof. In the folded position, a user may grasp a handle 148 (FIG. 4) that is secured to the front of the foot panel 140 to move the foot panel 140 and the mid-panel 130 towards a deployed configuration thereof.

Referring now to FIG. 13, as a user pulls the foot panel 140 from its stored position (FIG. 12) towards the deployed position (FIG. 14). As the foot panel 140 is lifted by a front of the foot panel 140, the mid-panel 130 rotates about the pivot bar 154 such that the mid-panel 130 is inverted about the pivot bar 154. As the mid-panel 130 rotates about the pivot bar 154, the gap closing mechanism 160 may urge the mid-panel 130 away from the arm 16 and/or the biasing mechanism 180 may assist in rotation of the mid-panel 130 as detailed above. As the mid-panel 130 approaches its deployed position, the rear link 157 rotates the rear leg 156 from the stored position towards a support position. As the rear leg 156 is rotated rearward towards its support position, the front link 159 is drawn rearward which draws the top of the front leg 158 rearward to rotate the front leg 158 towards the support position.

With particular reference to FIG. 14, when the foot panel 140 and the mid-panel 130 approach the deployed position, the front leg 158 and the rear leg 156 achieve the support position in which the front leg 158 and the rear leg 156 are substantially vertical to support the foot panel 140 in the deployed position. In the deployed position, the mid-panel 130 may be supported by the base 12 near a mid-point of the mid-panel 130 and at a front edge thereof by the rear leg 156 as shown in FIG. 14. The folding frame 150 operates in reverse to return the front leg 158 and the rear leg 156 to the folded position as the foot panel 140 and the mid-panel 130 are returned to the stored position.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. Convertible furniture comprising;

a first arm;

a first seat adjacent the first arm comprising a head panel, a mid-panel, and a foot panel, the first seat having a seat configuration in which the head panel is in a vertical orientation and the mid-panel and the foot panel are each in a horizontal orientation with the mid-panel inverted below the foot panel, the first seat having a bed configuration in which the head panel, the mid-panel, and the foot panel are each in a horizontal orientation with a top surface of each cooperating to form a flat surface; and a base having a first side rail that is secured to the first arm, a second side rail, and a center support parallel to and disposed between the first side rail and the second side rail, the head panel of the first seat at least partially supported by the first side rail and the center support in a deployed position thereof when the first seat is in the bed configuration.

2. The convertible furniture according to claim 1, wherein the head panel of the first seat includes an arm tab that extends from the head panel towards the first arm, the arm tab resting on the first side rail when the head panel is in the deployed position.

3. The convertible furniture according to claim 2, wherein only the arm tab of the head panel rests on the first side rail when the head panel of the first seat when the head panel is in the deployed position.

4. The convertible furniture according to claim 1, wherein the head panel of the first seat includes a center tab that extends from the head panel away from the first arm, the center tab resting on the center support when the head panel of the first seat is in the deployed position.

5. The convertible furniture according to claim 4, wherein only the center tab of the head panel rests on the center support when the head panel is in the deployed position.

6. The convertible furniture according to claim 5, further comprising:

a second arm; and a second seat between the first seat and the second arm comprising a head panel, a mid-panel, and a foot panel, the second seat having a seat configuration in which the head panel is in a vertical orientation and the mid-panel and the foot panel are each in a horizontal orientation with the mid-panel inverted below the foot panel, the second seat having a bed configuration in which the head panel, the mid-panel, and the foot panel are each in a horizontal orientation with a top surface of each cooperating to form a flat surface, the head panel of the second seat includes a center tab that extends from the head panel of the second seat towards the first arm, the center tab of the head panel of the second seat resting on the center support when the head panel of the second seat is in the deployed position, the center tab of the second seat offset from the center tab of the head panel of the first seat along the center support.

7. The convertible furniture according to claim 6, wherein in the deployed position, only the center tab of the head panel of the second seat rests on the center support in the deployed position.

8. The convertible furniture according to claim 1, further comprising a gap closing mechanism including a first dome secured to the first arm, the mid-panel of the first seat engaged with the first dome in the bed configuration of the first seat to urge the mid-panel of the first seat away from the first arm.

9. The convertible furniture according to claim 8, wherein the gap closing mechanism includes a contact surface on the bottom of the mid-panel.

10. The convertible furniture according to claim 1, further comprising a pivot bar that extends between the first arm and the center support, the mid-panel of the first seat rotatably secured to the pivot bar, the mid-panel rotating about the pivot bar between a stored position when the first seat is in the seat configuration and a deployed position when the first seat is in the bed configuration.

11. The convertible furniture according to claim 10, further comprising a first biasing mechanism configured to urge the mid-panel of the first seat from the stored positioned thereof to the deployed position thereof.

12. The convertible furniture according to claim 11, wherein the first biasing mechanism provides less force than required to rotate the mid-panel of the first seat from the stored position to the deployed position.

13. The convertible furniture according to claim 11, wherein the first biasing mechanism ceases to urge the mid-panel of the first seat from the stored position towards the deployed position after the mid-panel of the first seat has rotated 90 degrees about the pivot bar.

14. The convertible furniture according to claim 11, wherein the first biasing mechanism includes a torsion spring having a body disposed about the pivot bar, a first leg fixed relative to the first arm, and a second leg that is engaged with the mid-panel.

15. Convertible furniture comprising:

a base having a side rail, a back rail, and a center support, the side rail and the center support parallel to one another and perpendicular to the back rail; and a head panel having a stored position in which the head panel is substantially vertical in orientation and a deployed position in which the head panel is horizontal in orientation, the head panel supported by the side rail and the center support in the deployed position thereof, the head panel including a first tab and a second tab that extend laterally from sides of the head panel, the first tab resting on the side rail and the second tab resting on the center support in the deployed position.

16. The convertible furniture according to claim 15, wherein the head panel is substantially rectangular in shape.

17. The convertible furniture according to claim 16, wherein only the first tab of the head panel rests on the side rail when the head panel is in the deployed position and only the second tab rests on the center support when the head panel is in the deployed position.

18. The convertible furniture according to claim 15, further comprising a backrest adjacent the back rail, the backrest defining a cavity that receives the head panel in the stored position thereof.

19. Convertible furniture comprising;

a first arm;

a second arm;

a first seat adjacent the first arm comprising a first head panel, a first mid-panel, and a first foot panel, the first seat having a seat configuration in which the first head panel is in a vertical orientation, the first seat having a bed configuration in which the first head panel, the first mid-panel, and the first foot panel are each in a horizontal orientation with a top surface of each cooperating to form a flat surface, the first head panel of the first seat having a first center tab that extends from a side of the first head panel towards the second arm;

a second seat between the first seat and the second arm comprising a second head panel, a second mid-panel, and a second foot panel, the second seat having a seat configuration in which the head panel is in a vertical orientation, the second seat having a bed configuration in which the second head panel, the second mid-panel, and the second foot panel are each in a horizontal orientation with a top surface of each cooperating to form a flat surface, the second head panel of the second seat having a second center tab that extends from a side of the second head panel towards the first arm; and a base having a center support disposed between the first arm and the second arm, the first center tab resting on the center support in the horizontal orientation of the first head panel, the second center tab resting on the center support in the horizontal orientation of the second head panel, the first center tab offset from the second center tab along the center support.

20. The convertible furniture according to claim 19, wherein the first head panel includes a first arm tab that extends from the first head panel towards the first arm, the second head panel including a second arm tab that extends from the second head panel towards the second arm, the base including a first side rail attached to the first arm and a second side rail attached to the second arm, the first arm tab resting on the first side rail to support the first head panel in a horizontal orientation thereof, the second arm tab of the second head panel resting on the second side rail to support the second head panel in the horizontal orientation thereof.

* * * * *